US007427181B2

(12) United States Patent
Denton et al.

(10) Patent No.: US 7,427,181 B2
(45) Date of Patent: Sep. 23, 2008

(54) COMPOSITE DRAIN PLUG

(75) Inventors: Dennis Nelson Denton, Weddington, NC (US); Thomas Sochacki, Brighton, MI (US)

(73) Assignee: SKF USA Inc., Elgin, IL (US)

( * ) Notice: Subject to any disclaimer, the term of this patent is extended or adjusted under 35 U.S.C. 154(b) by 262 days.

(21) Appl. No.: 11/458,165

(22) Filed: Jul. 18, 2006

(65) Prior Publication Data

US 2008/0019795 A1 Jan. 24, 2008

(51) Int. Cl.
*F16B 35/00* (2006.01)
*B03C 1/28* (2006.01)

(52) U.S. Cl. ..... 411/383; 411/371.1; 411/901; 411/903

(58) Field of Classification Search ..... 411/383, 411/900–903, 396, 369, 370, 371.1
See application file for complete search history.

(56) References Cited

U.S. PATENT DOCUMENTS

| | | | |
|---|---|---|---|
| 3,869,391 | A | 3/1975 | Kramer |
| 4,810,148 | A | 3/1989 | Aisa et al. |
| 5,420,557 | A | 5/1995 | Chern |
| 5,588,502 | A | 12/1996 | Bedi et al. |
| 6,802,680 | B1 | 10/2004 | Rubenstein |

FOREIGN PATENT DOCUMENTS

| | | |
|---|---|---|
| JP | 62060910 | 3/1987 |

*Primary Examiner*—Flemming Saether
(74) *Attorney, Agent, or Firm*—Vedder Price P.C.

(57) ABSTRACT

A composite drain plug for an automobile engine. The drain plug is made up of a hollow metal sleeve that is flanged at one end and closed at the other end. There is a core portion filling the hollow sleeve and having a head portion and a stub flange adjacent the flanged end of the sleeve. A circumferential sealing bead is bonded to the stub flange. The core portion is a glass-filled polymer and the sealing bead is made from a material which includes a cross-linked elastomer dispersed in a thermoplastic carrier.

14 Claims, 2 Drawing Sheets

COMPOSITE DRAIN PLUG

BACKGROUND OF THE INVENTION

The present invention relates generally to automotive-related specialty products, and more particularly, to a composite drain plug for use in the oil pan of an automotive engine, or for use in another application wherein a fluid is sealed within an enclosed area from which it is desired to permit periodic draining and replenishment of fluid requiring plug removal. When used as a drain plug for an automotive engine oil pan, the one-piece unit of the invention comprises a plug body and a seal arrangement having a number of design features particularly adapted to solve persistent problems in the area of drain plug sealing.

By way of background, in the automotive industry, literally millions of automotive engines are produced every year. Each of these engines is designed to operate for an extremely extended life, and according to current practice in the automotive industry, such engines are designed to operate with an absolute minimum of maintenance. At the current time, oil change intervals of 5,000 to 7,500 miles or more are not uncommon. In earlier times, oil change intervals of 1,000 to 2,000 miles were common. Accordingly, under earlier conditions, slight leakage from drain plugs was not a critical matter, inasmuch as fluid replenishment was both common and frequent.

Referring to another, more important problem, that of modern automotive design, for environmental reasons as well as for reasons of warranty coverage, virtually absolute reliability is becoming a requirement in the automotive industry. With the increased cost of automobile engines, and particularly in view of their incorporation into compact mechanisms which include front wheel drive assemblies and the like, replacement of an engine under warranty is not only highly expensive, but is also a highly labor-intensive operation. In this latter aspect, the trend to making modern mechanisms more compact in the interest of space and weight saving has further aggravated the trend toward rendering engines and their parts almost inaccessible.

Accordingly, it is of the utmost importance that an engine or like sealed and lubricated component not fail by reason of a leaky drain plug. In the automotive industry, it was at one time common to use a steel-to-soft metal interface, usually in the form of a brass or copper washer, as a part of the drain plug sealing mechanism. However, with repeated use, such washer might be lost, scored or otherwise damaged, so such an approach has not been fully satisfactory. Cost and lack of reliability are also drawbacks to the approach of separate sealing elements.

For some time, synthetic resinous materials have been used as washers in sealed applications. While there are some advantages to this approach, new automotive engines achieve constantly higher operating temperatures, at least transiently, and obtaining suitable plastic materials for sealing engine parts is difficult.

Moreover, the practice of painting engine components, as well as painting entire cars, now commonly involves processes wherein either the entire automobile or the components thereof are baked for curing purposes under considerable heat by infrared lamps or otherwise. Under these conditions, resinous materials used as a part of the sealing system may have either been inadequate to withstand high temperatures, or more commonly, the resinous material undergoes cold flow and takes a compression set, thus compromising the residual compressive force needed to maintain a seal.

Thus, a part which is initially sealed in a highly fluid-tight manner might lose its seal with the passage of time. Some such units may even lose substantial sealing effectiveness before leaving the place of manufacture.

Certain attempts have been made to provide electrometric seals for these applications, but the use of separate elastomeric washers and the like has created problems with assembly, and also has created problems of controlling the degree of compressive force which is applied as the parts are fastened together during assembly. While insufficient forces create a risk of leakage, excessive forces have been known to damage the elastomeric or plastomeric seal components and thus create a risk of leakage in the short or long term.

Referring now to another aspect of modern manufacture and quality assurance, it has always been desired to place the responsibility for the effectiveness of any one mechanism, particularly parts that create a seal, with one manufacturer so that quality can be assured and so that responsibility can be properly located. Accordingly, manufacturers almost always wish to have mating parts made by the same entity, if this can be done as a practical matter.

In view of the failure of the prior art to provide a completely satisfactory and economical oil pan sealing system, it is therefore an object of the present invention to provide an improved such product at low cost.

Another object of the invention is to provide a composite drain plug having an integral sealing element bonded thereto and adapted for highly reliable installation.

A still further object is to provide a plug design which by reason of the type of materials used limits the torque which can be applied by the user.

A still further object is to provide a drain plug having a metal threaded portion, a head portion with a stub flange made from a thermoplastic material, and an enlarged flange and gasket portion made from an overmolded thermoplastic vulcanizate.

A still further object is to provide a drain plug which includes a specially shaped metal exterior, a plastic head, an internal body and stub flange and an elastomeric seal element integrally bonded to and serving as an extension of the flange.

Another object is to provide a drain plug which includes a steel threaded sleeve along with two other components comprising the bolt head and the sealing flange.

A still further object is to provide a drain plug having a reduced cost as well as higher quality in relation to prior art drain plugs.

Yet another object is to provide a drain plug which can be made with fewer steps, owing to its manufacturing method.

A further object is to provide a drain bolt which includes a metal sleeve which requires no preparation for rust protection, and in which the bolt head portion may be made in colors, if desired.

SUMMARY OF THE INVENTION

The invention provides a drain plug or the like having a hollow metal sleeve, preferably steel, with or without a cavity for receiving a magnetic material, a head portion including a stub flange made from a high temperature resistant engineered thermoplastic material, and a definite depth or movement stop for the plug embodied in a flange extension and being made from a third material or thermoplastic vulcanizate, and being arranged so that there is a desirable residual compressive sealing force that remains when there is contact between the associated composite part and the sealed portion.

The exact manner in which the foregoing and other objects and advantages are achieved in practice will become more fully apparent when reference is made to the following detailed description of the preferred embodiment of the invention set forth by way of example and shown in the accompanying drawings, wherein like reference numbers indicate corresponding parts throughout.

DESCRIPTION OF THE PREFERRED EMBODIMENTS OF THE INVENTION

Although it will be understood there are various ways of making some of the products described and changes can be made to the form of invention which will now be described, a pair of inventive, slightly different designs will now be illustrated.

Figure 2:
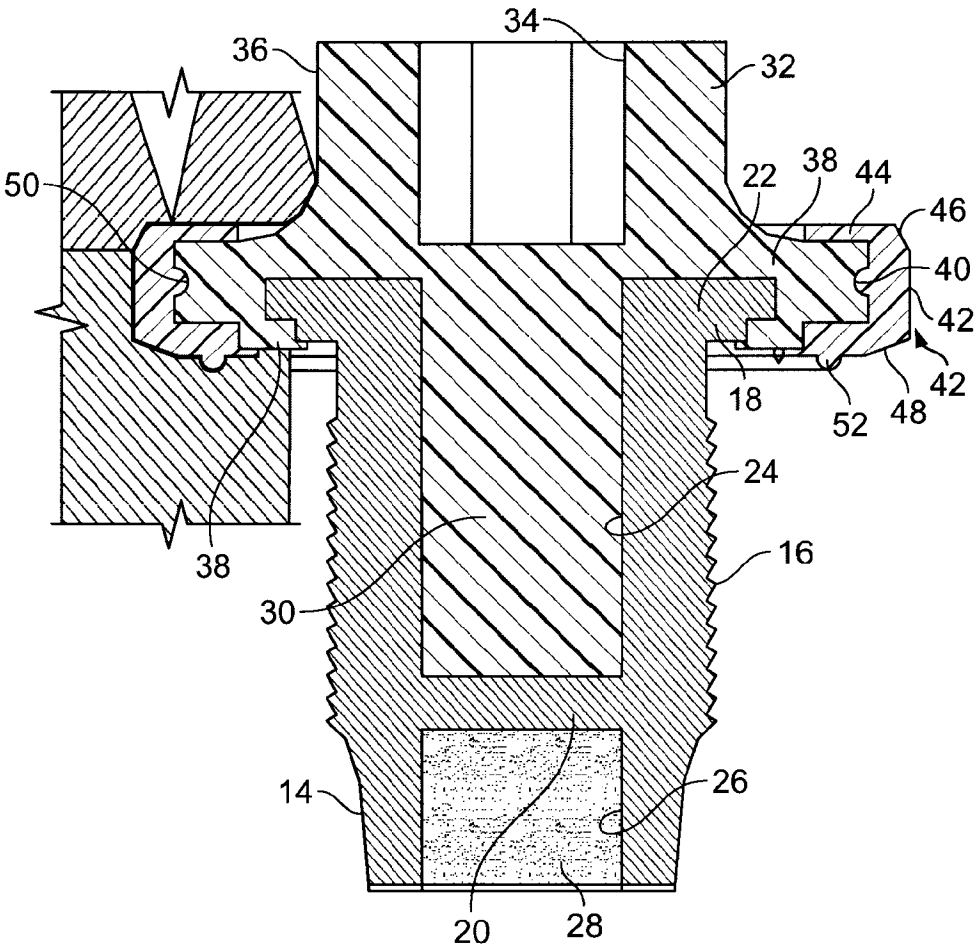
FIG. 2 is a vertical sectional view of the fastener of FIG. 1, showing the same to be made with the three different kinds of material and an optional space for a drain plug magnetic component in the bottom, and also showing a fragmentary portion of a mold used in overmolding the third material to the second material.
Figure 1:
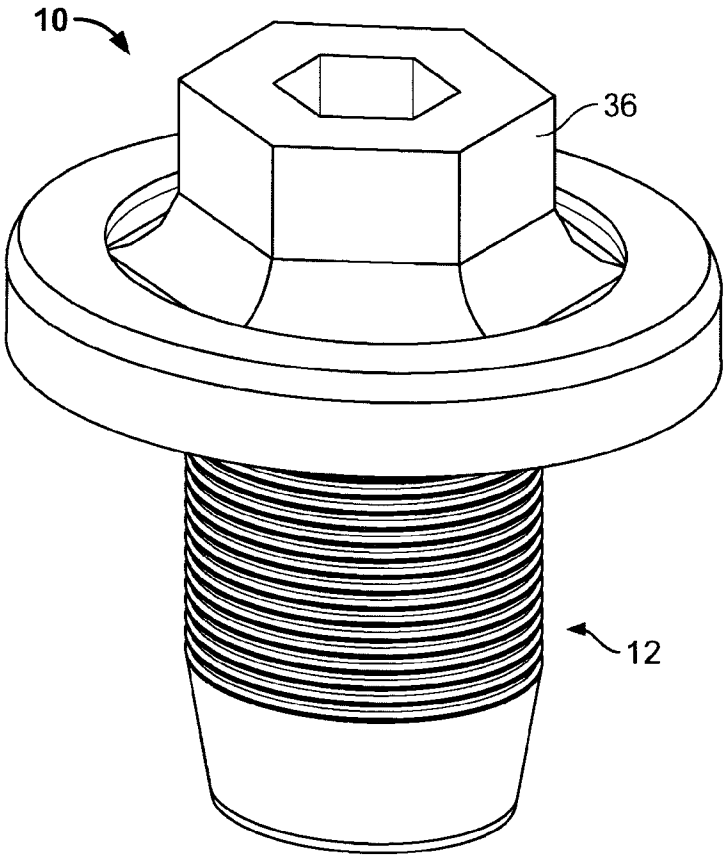
FIG. 1 is an isometric view showing one form of drain bolt or the like having an exterior hex head as well as an allen wrench well for receiving a tool.

Referring now to FIGS. 1 and 2, there is shown one form of drain plug or drain bolt assembly generally designated 10.

The first component of this assembly 10 is a metal sleeve generally designated 12 as shown to include a lower, thread-free portion 14, an exterior threaded portion 16, and a flange portion 18. The sleeve includes a bottom wall 20 and a flat top portion 22. There is defined an elongated interior wall 24, and a shortened interior wall portion 26. These walls 20, 26 leave a pocket 28 which optionally contains a magnet or a magnetic material to attract small metal filings from the engine itself. The elongated interior wall 24 and the top flange 22 define most of the volume of the engineered thermoplastic core 30, which also includes a shank portion 31 and also a head portion 32 having a hexagonal well 34 to accommodate an allen wrench, while the exterior of the wall 30 includes a hex pattern 36.

The plastic material 30 also has a stub flange 38 extending therefrom and this includes a pocket 40 to create a gripping surface and the thermoplastic material also surrounds the stub flange 38 at the bottom 39, with the thermoplastic material underlying and completely surrounding the metal sleeve flange 18. It is important that the walls 24 are of a non-circular configuration, thus ensuring that the sleeve will turn with the core 30.

Outside of the stub flange 38 is an exterior flange made from a thermoplastic vulcanizate generally designated 42 and shown to include an upper, radially extending surface 44, a beveled surface 46, an exterior cylindrical surface 48, and a lower radially extending surface 50. The portion 42 includes a small cleat 52 to insure gripping and includes a bead 54 on the bottom surface 50 thereof, to provide a deformable jacket for sealing purposes.

Figure 5:
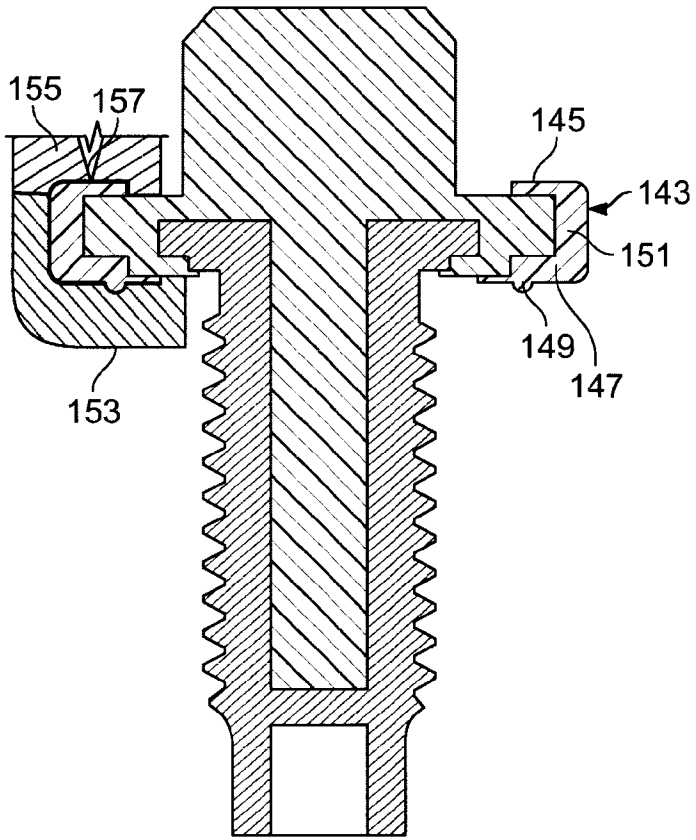
FIG. 5 is a vertical sectional view showing the metal sleeve, the engineered thermoplastic head and stub flange, and the overmolded thermoplastic vulcanizate comprising the flange extension and the gasket, and showing the manner in which the flange extension and gasket are overmolded onto the stub flange.
Figure 4:
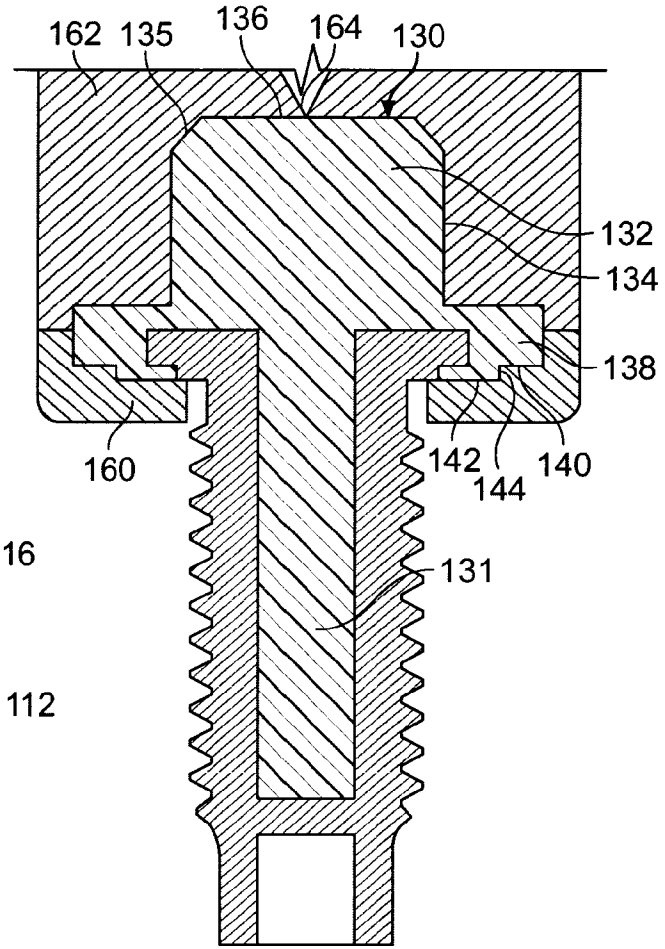
FIG. 4 is a vertical sectional view, showing the metal sleeve, filled with an engineered thermoplastic sleeve, a fastener head portion, and a stub flange extending from the head and the core; and showing the mold in which the engineered thermoplastic material is formed.
Figure 3:
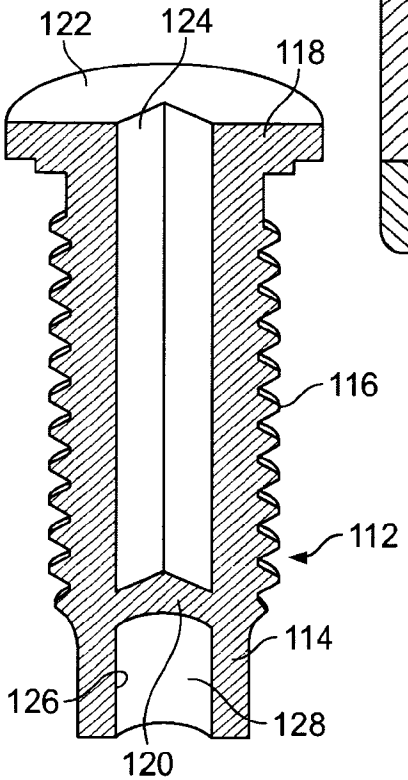
FIG. 3 is an isometric half section figure showing one modified form of the invention, showing a non-circular cavity in the shank portion of the seal sleeve, and having an optional reentrant portion at the bottom thereof.

Referring now to FIGS. 3-5, a slightly modified form of the drain bolt assembly 110 is shown. This portion includes a metal sleeve generally designated 12 and shown to include a lower, thread-free portion 114, an exterior threaded portion 116, and a flanged portion 118, containing horizontal surfaces 119, 121. This sleeve 112 includes a bottom wall 120 and a flat top surface 122. There is a elongated interior wall 124 and a shorter, lower interior wall 126. The pocket 128 may optionally contain a magnet or a magnetic material to attract filings suspended in the oil from the interior of the engine. It will be noted that the elongated portion 124 of the wall is also shown to be square when viewed from the top, which is important in ensuring that the bolt does not twist relative to the head. Any other non-circular shape would also suffice, of course.

Sufficient space is provided for the engineered thermoplastic core generally designated 130, and which includes a shank portion 131, and a head portion 132 of somewhat different configuration than its counterpart in FIGS. 1 and 2. This head portion 132 is shown to include an exterior flat, horizontally extending hexagonal surface 134 for engagement by a wrench, a small beveled portion 135 and a flat upper surface 136. The head 132 is shown to include a stub flange 138 extending outwardly from the flange portion 118 of the sleeve 112. The stub flange 138 includes a lower horizontal surface portion 140, a further, smaller diameter lower surface portion 142 and a small vertical wall 144 connecting the surfaces 140, 142. The head portion 132 is made from an engineered thermoplastic material and is somewhat raised in relation to its counterpart 30, and also has a slightly larger diameter, to accommodate greater torque in fastening the bolt 110.

Referring now to the manner of molding the head portion 132 and the shank portion 131 of the engineered thermoplastic material, two mold halves are shown to close over the flange portions 118 of the sleeve 112. These mold halves include a lower portion or mold half 160 and an upper mold half 162, and include a sprue 164 shown in the middle of the upper mold part 162. The glass-filled thermoplastic material is injection molded, and acquires the shape provided by the somewhat schematically shown two mold halves 160 and 162. Since the material is thermoplastic, it requires no curing, and the molding is done in a matter of seconds.

Another important feature of the invention is the manner in which the exterior flange generally designated 143 is made. This method involves so-called "overmolding", with part of the mold being used to form one part of the finished product, and the previously formed plastic surface used to form the remainder of the product. The finished overmolded product is inherently bonded to the previously molded product. Thus, there are two molded shapes involved, with each shape being partially embodied in the final product. This flange has an upper surface 145, a lower surface 147, a gasket cleat or rib 149, and an enlarged diameter exterior flange 151. These portions are formed in the mold halves 153, 155, and are created by injecting the thermoplastic vulcanizate through the sprue 157 in the upper mold half 155.

The particular material used in the core 131 and the head 132 as well as the stub flange 138, etc. is an injection molded, material with a 50% glass fiber content dispersed in a semi-crystalline polyamide, with a partially aromatic co-polyamide forming a part thereof. These materials are somewhat analogous to nylon, and they feature high stiffness and strength, and great dimensional stability. These materials have good chemical resistance and are able to provide a good, polished surface finish.

The injection is shown somewhat systematically, but typically the material has a melting point of about 260° C. This material has a density of about 1.50 to 1.60 and has about 1.3% to 1.5% moisture absorption at 23° C. and 50% relative humidity. The resulting nylon head formation and shank portion are eminently suitable for use in the heavy duty environment anticipated. The somewhat square interior walls 124 provide for more than adequate torque transmission, and in a typical application, the head portion has a width of 15 millimeters for a 12 to 13 millimeter shank.

The covering of the stub flange with an exterior flange generally designated 143 is accomplished by using a thermoplastic vulcanizate. In other words, the material used in this phase of the manufacture can be molded with the rib portion 149 internally formed on the outer flange 151. This outer flange material is a thermoplastic elastomer, which is made from a high performance, previously cross-linked elastomer which is dispersed very finely in a high performance thermoplastic elastomer.

This material is made from an ethylene acrylic elastomer, and a thermoplastic ether ester elastomer. This material, unlike ordinary rubber which must be cross-linked to become effective, uses standard thermoplastic processing techniques, such as injection molding. The parts do not need to be post cured, resulting in much lower cycle times, and therefore, higher productivity. The material is obtained in ready-to-use compounded form, and does not require any plasticizers or the like.

The material is lower in price than high performance rubbers. As a result of using this material in injection molding, the matter is very much simplified in relation to awaiting curing that would be required with ordinary rubbers.

The drain bolt of FIGS. 1 and 2 is made in the same way as is the bolt in the example of FIGS. 3-5. The product has all the advantages of the product of example FIGS. 3-5, except that it cannot take as much torque. However, it has a well for accommodating an alien wrench for one mode of tightening. Thus, the head includes both an internal and external hexagon configuration.

Both of these drain plug devices do away with the need to prepare the metal for bonding with the elastomer, which is naturally adhesive to the core material. The illustrated examples provide the option of using a magnetic component in the bottom opening. The bolt head, being made entirely from plastic, is free from rust and will ultimately limit the torque applied, if necessary. The bolt head may be made from a colored material and thus has the additional advantage of identifying a supplier.

The cost is less than that of its predecessor, because the threaded sleeve cost is considerably less than a finished, all-steel bolt. The time to manufacture is greatly reduced, since thermoplastic methods of molding and overmolding create a cycle time which is considerably less than that required of ordinary rubber. There is no exposed metal and consequently there cannot be any rust with the inventive product.

As a result of the design, there is almost no way in which the oil pan with which this drain bolt is associated could be damaged. The overmolding method saves not only time, but expense, since, as pointed out, the overmolding method uses a portion of the thermoplastic core as the other portion of the mold.

It will thus be seen at the present invention provides a new product and a method of making it, having a number of advantages and characteristics, including those pointed out and others which are inherent in the invention.

What is claimed is:

1. A composite drain bolt comprising, in combination, a threaded metal sleeve being closed at one end and having a radially extending sleeve flange at the other end, and a non-circular bore extending axially from said sleeve flanged end, a core portion filling said bore portion of said sleeve, said core portion having a stub flange axially adjacent and of larger diameter than said sleeve flange, said core portion also having a head portion shaped to receive a wrench, said core portion being made from a glass-filled thermoplastic resin, and an exterior flange extending radially from and at least partially covering at least two sides of said stub flange, said exterior flange including a circumferential sealing bead extending axially away from the remainder of said exterior flange and said head portion, said exterior flange being made from a material which includes cross-linked elastomer particles dispersed in a thermoplastic carrier.

2. A composite drain plug as defined in claim 1 wherein said metal is steel.

3. A composite drain plug as defined in claim 1 wherein said metal sleeve includes a pocket in the end opposite said sleeve flange, said pocket having a magnetic material inserted therein.

4. A composite drain bolt as defined in claim 1 wherein said head portion shaped to receive a wrench includes side portions in a hexagonal shape and a well portion for receiving an allen wrench.

5. A composite drain bolt as defined in claim 1 wherein said head portion shaped to receive a wrench includes a square head portion.

6. A composite drain bolt as defined in claim 1 wherein said head portion shaped to receive a wrench includes a hexagonal head portion.

7. A composite drain bolt as defined in claim 1 wherein said glass-filled thermoplastic resin is a polyamide resin.

8. A composite drain bolt as defined in claim 1 wherein said resin is a semi-crystalline polyamide with a partially aromatic co-polyamide forming a part thereof.

9. A composite drain bolt as defined in claim 1 wherein said exterior flange is made from an ethylene acrylic elastomer dispersed in a thermoplastic ether ester elastomer.

10. A composite drain bolt as defined in claim 1 wherein said resin is color-coded.

11. A method of making a drain bolt, said method including the steps of forming a metal sleeve with an axially extending, non-circular bore on the interior thereof, threading the exterior of said sleeve and forming a sleeve flange thereon, filling said non-circular bore, forming a head portion, a shank portion in said bore and a stub flange axially adjacent and of larger diameter than said sleeve flange in one piece from a glass-filled thermoplastic resinous material, and thereafter forming a finished flange extending radially away from and at least partially covering at least two surfaces of said stub flange, said finished flange including a sealing bead portion extending axially toward said threads, said finished flange being made from a material including particles of a cross-linked elastomer finely dispersed in a thermoplastic carrier material.

12. A method as defined in claim 11 wherein said glass-filled thermoplastic resinous material is a polyamide resin.

13. A method as defined in claim 11 wherein said glass-filled thermoplastic resinous material is a semi-crystalline polyamide with a partially aromatic co-polyamide forming a part thereof.

14. A method as defined in claim 11 wherein said material from which said finished flange is made is an ethylene acrylic elastomer dispersed in a thermoplastic ether ester elastomer. extending radially away from and at least partially covering.

* * * * *